US006209225B1

(12) United States Patent
Villarroel et al.

(10) Patent No.: US 6,209,225 B1
(45) Date of Patent: Apr. 3, 2001

(54) ROTATOTY DRYER FOR COPPER CONCENTRATE

(76) Inventors: Danilo Villarroel, Av. Tobalaba 3696, Puente Alto, Santiago (CL); Peter D. Morley, 2392 Catlett Mountain Rd., Front Royal, VA (US) 22630

( * ) Notice: Subject to any disclaimer, the term of this patent is extended or adjusted under 35 U.S.C. 154(b) by 0 days.

(21) Appl. No.: 09/420,771

(22) Filed: Oct. 19, 1999

(30) Foreign Application Priority Data

Oct. 23, 1998 (CL) ..... 253998

(51) Int. Cl.[7] ..... F26B 11/02

(52) U.S. Cl. ..... 34/599; 34/602; 34/606; 432/124

(58) Field of Search ..... 34/77, 595, 599, 34/602, 606, 134, 137; 432/120, 124; 122/406.1; 266/160, 217, 241; 75/641; 165/86, 89, 104.25

(56) References Cited

U.S. PATENT DOCUMENTS 3,883,959 * 5/1975 Neville ..... 34/134 X
4,025,754 * 5/1977 Marzonie et al. ..... 34/132 X
4,538,360 * 9/1985 Chance et al. ..... 34/125 X
4,629,844 * 12/1986 Griffith et al. ..... 219/10.49 R
4,781,795 * 11/1988 Miller ..... 34/108 X
5,083,870 * 1/1992 Sindelar et al. ..... 34/137 X
5,119,886 * 6/1992 Fletcher et al. ..... 165/89
5,152,075 * 10/1992 Bonar ..... 34/60 X
5,220,732 * 6/1993 Lee ..... 34/131 X
5,263,267 * 11/1993 Buttner et al. ..... 34/179 X
5,990,450 * 11/1999 Kirker et al. ..... 432/124 X
5,997,290 * 12/1999 Hilingrathner ..... 432/124

* cited by examiner

*Primary Examiner*—Stephen Gravini

(57) ABSTRACT

A rotary dryer for copper concentrate including a tube-shaped heat distributor fixed to the structural drum, with tubular holes in the annular cross section where hot nitrogen is forced to flow. The concentrate is heated up by means of a numerous set of heat transfer bars, which are fixed in the internal periphery of the heat distributor and point into the radial direction. As a consequence of the rotation of the drum, the heat transfer bars also promote the mixing and the transport of the concentrate in the downstream direction.

1 Claim, 1 Drawing Sheet

ROTATOTY DRYER FOR COPPER CONCENTRATE

REFERENCE TO A MICROFICHE APPENDIX

Not Applicable.

BACKGROUND OF THE INVENTION

This invention relates to an indirect dryer for the process of drying copper concentrate in a copper smelter.

The indirect dryer in use in copper smelters is the multicoil steam dryer, where the heat for the drying process is provided by saturated steam supplied through a smelter's waste heat boiler, which uses the thermal energy of the gases of fusion and conversion. However, it is more efficient to use the thermal energy of these gases for electric power generation, while the heat for the drying process is obtained from the cooling of sources like: the smelting and converting furnaces, the slags, the anodes and other sources of heat that at present time are thrown away. The nitrogen generated in the oxygen plant is the natural fluid for transferring the heat from these hot sources to the wet concentrate; but the specific way of how to heat up the nitrogen is not a matter of this application.

The present dryer differs radically from the steam dryer, since the heating of the concentrate is not realized by means of tubes or multicoils. In particular, the problem of wear is not so critical as it is in the multicoil steam dryer. Moreover, the limitation of capacity up to 120 ton per hour that affects the multicoil steam dryer does not arise in this invention.

BRIEF SUMMARY OF THE INVENTION

This invention is directed to the drying process of copper concentrate that is required in a copper smelter. The fundamental piece of this rotary dryer is a tube-shaped Heat Distributor that is fixed to the structural drum, and which is made with a material of high thermal conductivity, like copper. In the annular cross section of the Heat Distributor, and all along the dryer, there is a large number of identical tubular holes, where hot nitrogen is forced to flow.

The heat is transferred to the concentrate by means of copper bars, the Heat Transfer Bars, that are fixed, with a good thermal contact, in the internal periphery of the Heat Distributor and that point into the radial direction, that is, in the direction orthogonal to the dryer axis. These bars have a rectangular cross section and they are set up in such a way that they resemble the structure of turbine blades.

Due to the large number of Heat Transfer Bars, a large number of square meters of heating surface per ton of concentrate are obtained. The Heat Transfer Bars also promote the mixing and transport of the concentrate along the dryer because of the rotation of the structural drum.

DETAILED DESCRIPTION OF THE INVENTION

Figure 1:
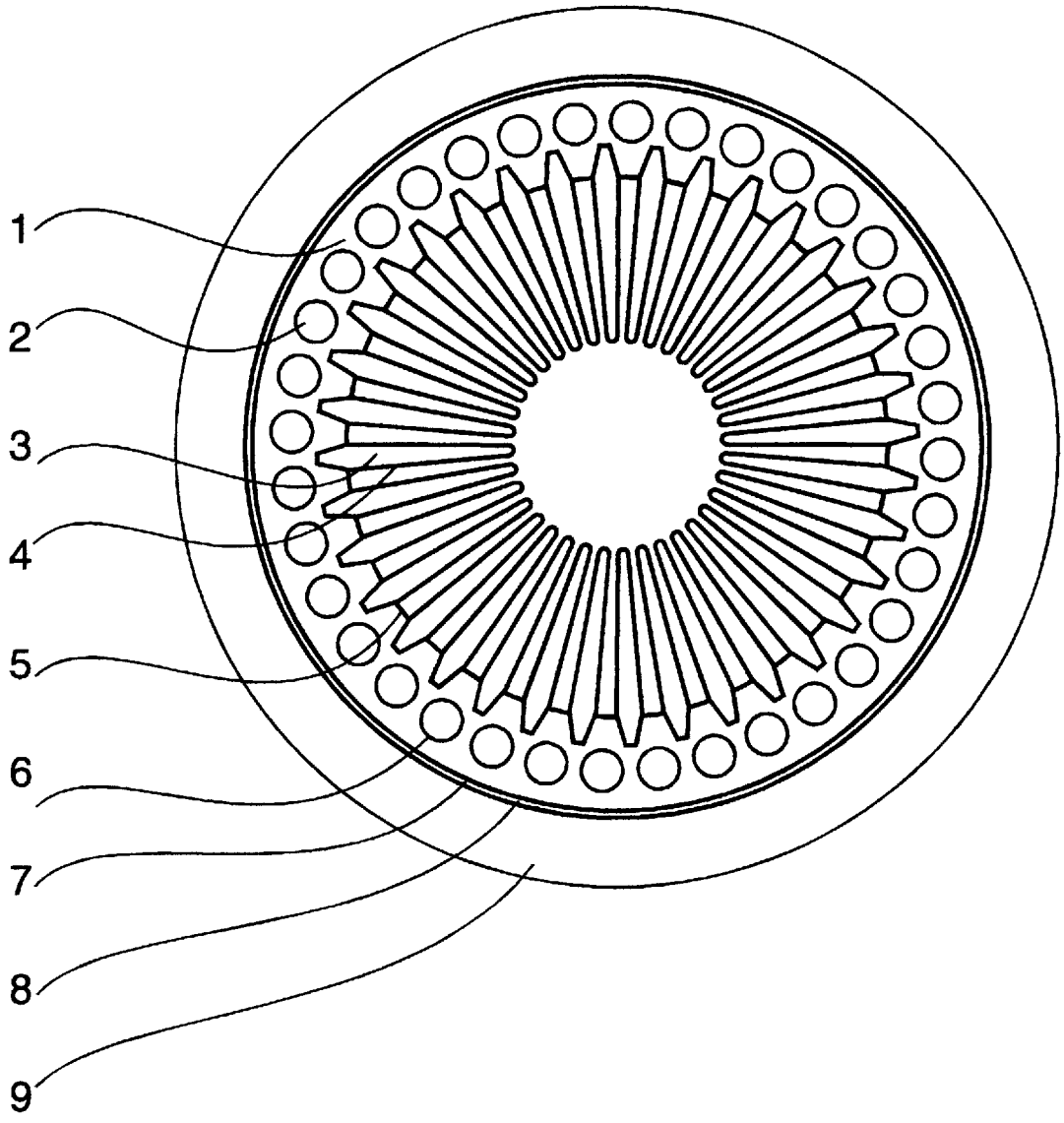
FIG. 1 shows a cross section of the invention, that is, a section obtained by a cut with a plane orthogonal to the axis of the dryer.

Like the traditional rotary dryer, in the present invention the concentrate is displaced as a consequence of the rotation and inclination of the structural drum. Also the drive and support mechanism of the drum are here the same as those of the traditional rotary dryer.

Referring to FIG. 1, the fundamental piece of the dryer is the tube shaped Heat Distributor 1, which is fixed to the structural drum 8; thus, both pieces rotate together during drying. The Heat Distributor is made with a metal of a high thermal conductivity. In the annular part and all along the Heat Distributor there are several identical tubular holes 2, where hot nitrogen at pressure is forced to flow. The tubular holes 2 are, of course, parallel to the dryer axis.

The concentrate is heated up by means of the Heat Transfer Bars 3, which are fixed to the body of the Heat Distributor 1, and with a good thermal contact with it. Like the Heat Distributor, the material of the Heat Transfer Bars has a high thermal conductivity. Given the large thermal conductivity of copper and its low cost, it appears as the most appropriate metal for constructing both the Heat Distributor and the Heat Transfer Bars. Unfortunately, copper has a poor resistance to both the aggressive environment prevailing inside the dryer and the erosive nature of the concentrate. These drawbacks are overcome by means of the protective jacket of stainless steel 4 on the Heat Transfer Bars. This jacket also ensures the structural integrity of the Heat Transfer Bars against mechanical stress.

Since the Heat Transfer Bars are set up in the periphery and all along the Heat Distributor, there are a large number of them, which in turn gives rise to a very large heating surface. The root of the Heat Transfer Bar is forced in a special cavity located in the internal periphery of the Heat Distributor, so as to obtain a good thermal contact between them. With this end a truncated pyramidal shape both for the root of the Heat Transfer Bar and the cavity in the Heat Distributor is the most appropriate. The Heat Transfer Bar can be fixed then by means of a bolt inserted in a hole from the external periphery of the Heat Distributor. Also, since the temperature of the Heat Distributor is only of a few hundred Celcius degree and the pressure inside the dryer is near the atmospheric one, a protective gaslight seal between the Heat Transfer Bar and the Heat Distributor can be easily obtained with the help of a gasket.

The stainless steel tubes 5 and 7 in FIG. 1 are for the protection of the Heat Distributor against corrosion and abrasion. Since the nitrogen will be probably contaminated with oxygen and, perhaps, other corrosive gases, it is necessary to protect the surface of the tubular holes 2 of the Heat Distributor. This is done here by means of the thin metallic tube 6, which has a good thermal contact with the body of the Heat Distributor.

In order to facilitate the process of manufacture and assembly of the Heat Distributor, it is convenient to build it by means of several identical pieces.

The profile of the Heat Transfer Bars plays an important role in the drying process. The simplest profile seems to be a truncated cone, that is, a bar with a circular transversal section. However, here it will be chosen a profile with a rectangular cross section, since it is more advantageous. This profile allows the Heat Transfer Bar to play also the role of a lifter, improving in this way the mixing of the concentrate during the drying process. Moreover, in comparison with a bar of a circular cross section, this profile increases the time that the bar is in thermal contact with the concentrate.

With the purpose that the Heat Transfer Bars contribute to the transport of the concentrate along the dryer, it is useful that the longer side of the rectangular cross section makes a non-zero angle with the axis of the dryer. Such disposition would resemble then that of a turbine blades. Because of this disposition the concentrate is displaced in the downstream direction during its fall from the Heat Transfer Bars. Besides, they also push the concentrate of the bed in this direction, as a consequence of the rotation of the drum.

The removal of the water vapor generated in the bulk of the concentrate bed is more expedite if the outer surface of the protective jacket of the Heat Transfer Bars has a multiplicity of grooves along the radial direction, that is, in the direction orthogonal to the axis of the dryer.

Since the Heat Distributor 1 in FIG. 1 is mechanically fixed to the structural shell 8, the temperature of the later is as high as the temperature of the former. For this reason here it is strictly imperious to surround the shell 8 by means of the thermal insulating layer 9. There will be, of course, thermal losses across the drive and support mechanism of the dryer, but they are relatively small. The thermal insulating layer 9 also protects the structural drum 8 against oxidation.

Although there is more than one possible operating way for the dryer, the simpler one seems to be that where the concentrate and the hot nitrogen are fed by the top entrance mouth; while the dry concentrate and the exhaust water vapor are recovered at the bottom end of the dryer. In this case it is also advantageous to introduce a small flow of hot nitrogen at the entrance mouth, in order to promote the evacuation of the evaporated water inside the dryer.

Since the temperature and pressure of the nitrogen are moderate, the feeding of the dryer with it does not present any technical difficulty. The hot nitrogen can be forced to flow along the tubular holes 2 of the Heat Distributor by means of a hollow ring-shaped piece, whose geometrical form is obtained when a torus is cut by a plane that contains its main circumference. The internal and external diameters of the ring-shaped piece are, of course, the same that those of the annular section of the Heat Distributor of FIG. 1. Then a face seal between the fixed ring-shaped piece and the rotating annular end top of the Heat Distributor is obtained by pressing mechanically the former over the later. Because of its self-lubricating properties and its corrosion resistance, graphite is the primary candidate for these face seals.

What is claimed is:

1. A device comprising:

an indirect copper concentrate rotary dryer drum wherein the external surface of the drum is covered with a thermal insulating layer;

a tube-shaped heat distributor of the same length as the indirect copper concentrate rotary dryer drum and fixed to the internal periphery of the drum, wherein the heat distributor further comprises several identical pieces with an annular sector cross section and a length;

a set of uniformly distributed tubular holes in the annular cross section of the heat distributor, wherein hot nitrogen is forced to flow and further wherein the nitrogen is heated up in a sequence of steps, whereby a first step uses nitrogen as the cooling fluid for smelting and converting furnaces, and a second step heats the nitrogen while cooling slags, and a third step heats the nitrogen while cooling anodes;

a set of fixed bars for heating copper concentrate, with thermal contact, in the internal periphery of the heat distributor, in the radial direction orthogonal to the axis of the dryer and having a rectangular cross section in a plane parallel to the axis of the dryer with a constant length in the direction of the axis of the dryer and the longer side of the rectangular cross section makes a non-zero angle with the axis of the dryer such that the set of bars is that of a turbine blade type structure.

* * * * *